United States Patent [19]

Bassin

[11] Patent Number: 4,783,580

[45] Date of Patent: Nov. 8, 1988

[54] FLUID ACTUATED CONTROL DEVICE

[76] Inventor: Gilbert Bassin, 457 Marmaroneck Rd., Scarsdale, N.Y. 10583

[21] Appl. No.: 114,443

[22] Filed: Oct. 28, 1987

[51] Int. Cl.[4] ..... H01C 35/34

[52] U.S. Cl. ..... 200/81.4; 92/5 R; 200/83 J; 200/837

[58] Field of Search ..... 91/1; 92/5 R; 73/861.44, 861.47, 717, 723, 745; 340/626; 307/118; 200/81 R, 81 H, 81.4, 82 C, 83 R, 83 J, 83 S, 83 Y, 83 Z

[56] References Cited

U.S. PATENT DOCUMENTS

| | | | |
|---|---|---|---|
| 3,260,816 | 7/1966 | Schad | 200/83 J |
| 3,326,089 | 6/1967 | Machado | 200/83 J |
| 3,679,325 | 7/1972 | Yost | 200/83 J |
| 3,898,405 | 8/1975 | Weber | 200/83 J |
| 4,267,413 | 5/1981 | Reis | 200/83 Y |
| 4,384,183 | 5/1983 | Meshoularm | 200/81 H |

FOREIGN PATENT DOCUMENTS

| | | | |
|---|---|---|---|
| 262429 | 6/1968 | Australia | 200/83 Z |

*Primary Examiner*—G. P. Tolin

*Attorney, Agent, or Firm*—Kuhn and Muller

[57] ABSTRACT

A fluid controlled actuating device is described which facilitates rapid and controllable actuation of devices adapted for momentary actuation.

14 Claims, 4 Drawing Sheets

CONVENTIONAL SNAP SWITCH

FLUID ACTUATED CONTROL DEVICE

PRIOR ART

Fluid actuators are known, for example as disclosed in U.S. Pat. No. 3,710,571, which describes devices which can be used to actuate control devices having mechanically displaceable actuator members. However, such fluid actuator devices are not fully satisfactory for use with an array of control devices which require simultaneous or sequential operation and particularly with devices such as momentary action electrical switches, electrical snap switches and the like.

BACKGROUND OF THE INVENTION

The actuation of control devices having mechanically displaceable actuator members, using pressure switch fluid actuator devices of the type noted above, is a common practice. However, such devices are not always capable of reliably providing the force required, e.g. to simultaneously actuate a plurality of certain known types of control action devices, i.e. momentary action electrical switches, electrical snap switches, optical shutters fiber optic switches, fluid control valves and the like, particularly when arranged in side-by-side arrays. Also, such fluid actuator devices are not entirely suitable for use in actuating snap switches of higher electrical ratings; this type of switch being relatively heavily spring loaded and requiring a relatively high applied force in order to be actuated. This is particularly the case when an alternate action mechanism is employed with a multiplicity of control devices, due to the increased friction and inertia of the system.

THE INVENTION

The invention solves the aforedescribed problems by providing a fluid controlled, e.g. air or gas controlled device which includes a displaceable member, e.g. a resilient diaphragm or a piston, engaged in a housing which, upon being displaced, moves a rod member which drives a transverse bridge member against a mechanically displaceable actuator of a control device, or a side-by-side array of actuators of control devices of the type described herein which are held in the housing. The bridge member is urged, in the same direction as it is being driven by the rod member, by a pre-established force developed by a resilient member which is in compression between the bridge member and the housing of the fluid controlled device. Due to the pre-established force acting on and partially displacing the actuators of the one or more control devices, which can be a fixed force or an adjustable force, the amount of force required from the fluid controlled actuating device can be reduced to a minimum or otherwise optimized, and simultaneous or sequential actuation of a plurality of control devices is enabled. The aforementioned pre-established force can be arranged to be closely adjustable by the use of shimming type devices which can be utilized to increase or decrease the compression force applied to the displaceable actuator members of the control devices.

BRIEF DESCRIPTION OF THE DRAWINGS

FIGS. 1(*a*) and 1(*b*) are partially broken views.

FIG. 2(*a*) shows a plan view of the bridge element illustrated in FIG. 2.

FIG. 2(*b*) schematically illustrates a type of control device for which the present invention is particularly applicable.

FIG. 2(*c*) illustrates an embodiment of the invention which enables sequential actuation of control devices.

Figure 1A:
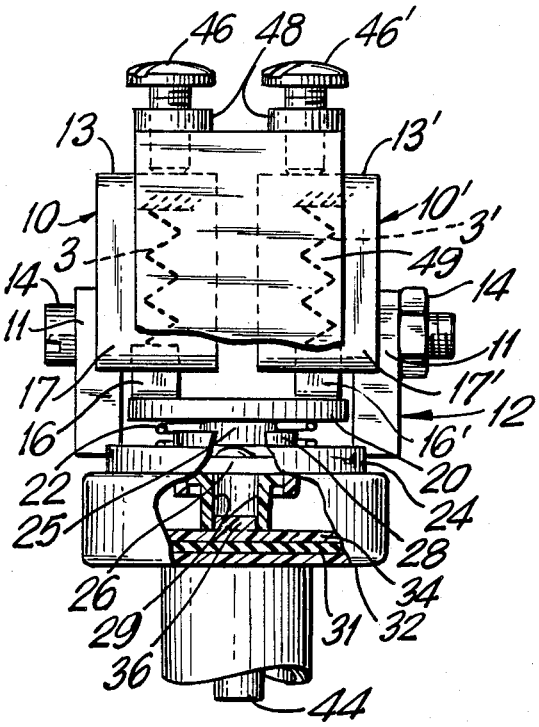
FIGS. 1(*a*), 1(*b*) and 1(*c*) are a rear elevation, side elevation and plan view, respectively, of a particular preferred embodiment of the present invention.
Figure 1B:
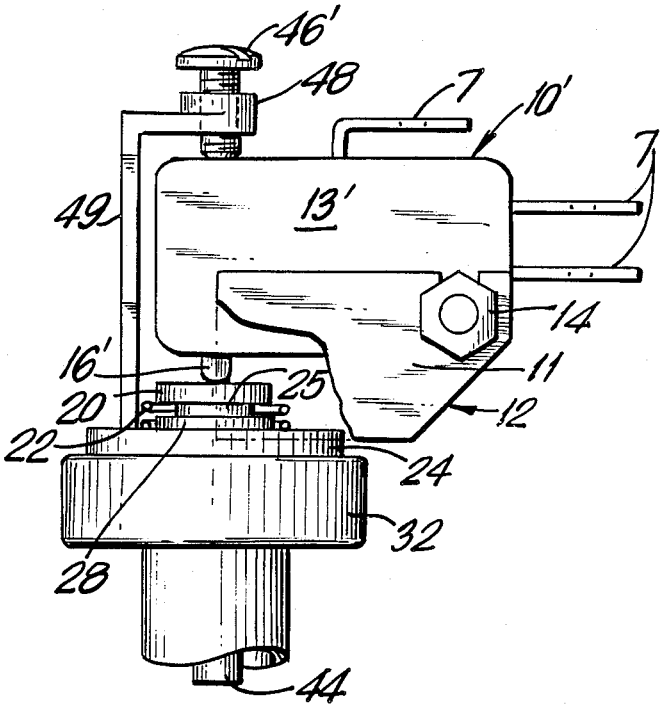
Figure 1C:
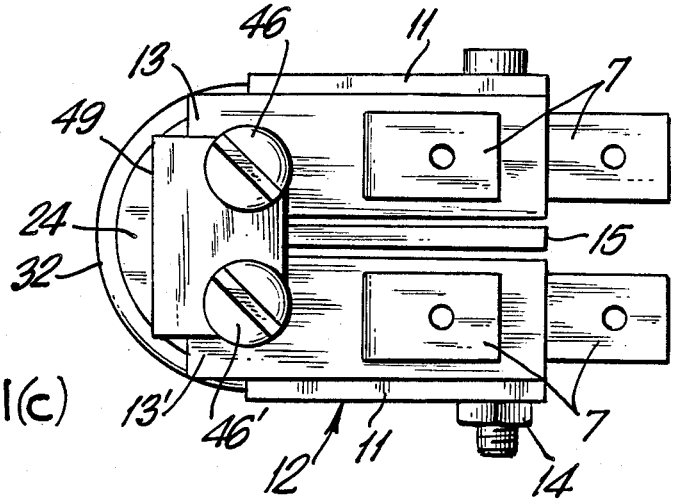
Figure 2:
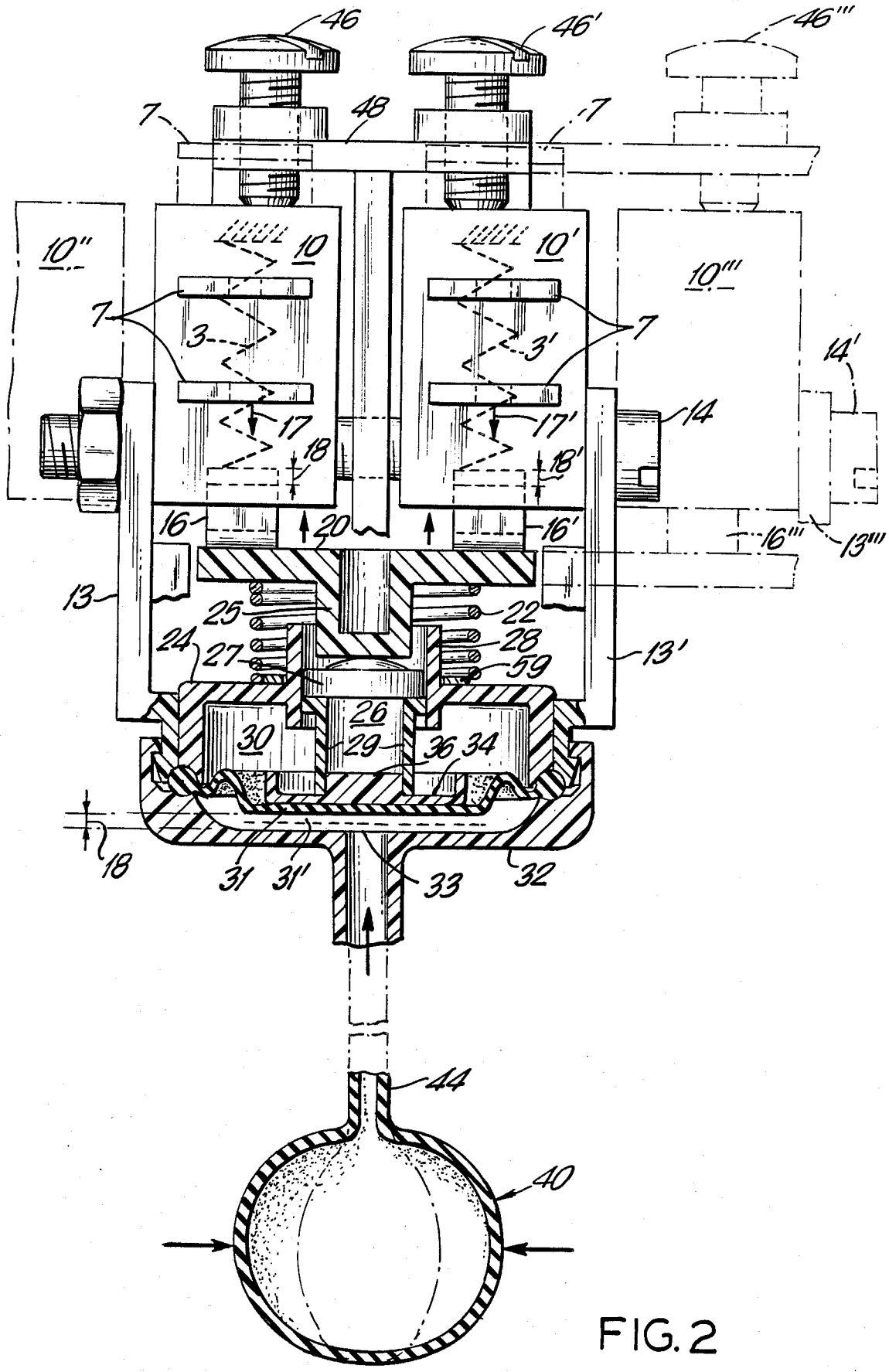
FIG. 2 is a partial front elevation view in section of the device of FIGS. 1(*a*)–(*c*).
Figure 2A:
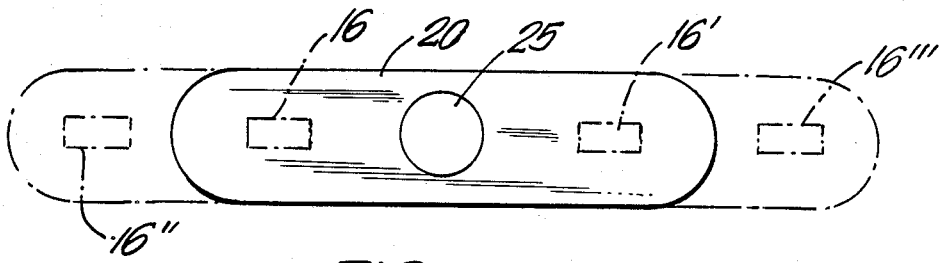
Figure 2B:
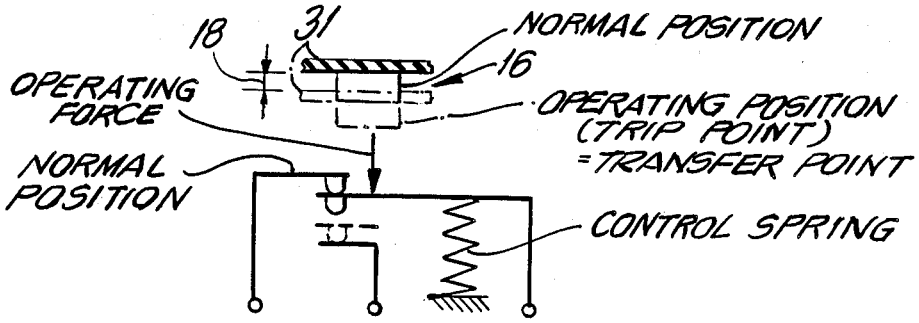
Figure 2C:
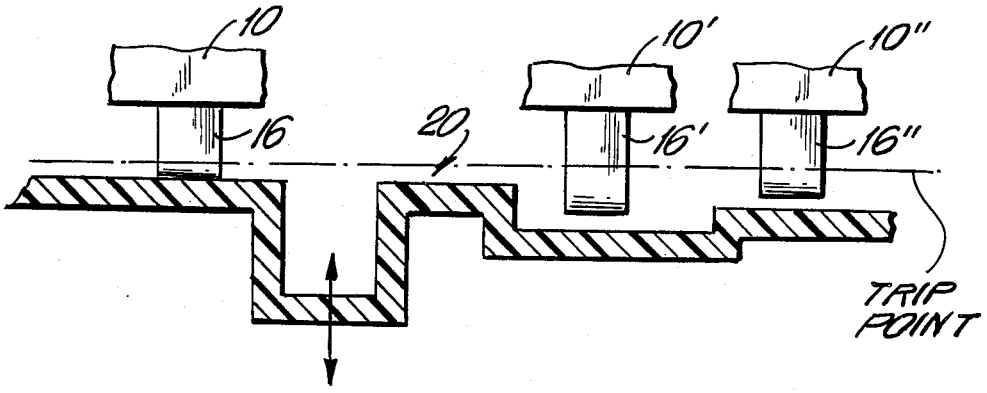

With reference to the drawing, FIGS. 1(*a*)–(*c*) and 2 in particular, a pair of control devices, exemplified by electrical switching devices, is indicated at 10, 10' representing momentary action and snap switch types. The switches 10,10' are held in a housing 12 by a conventional through-bolt arrangement 14 which passes through pre-existing holes in the housing 12 which has integral side brackets 11 and an integral spacer element 15 enclosing the structures 13,13' of switching devices, 10,10'. The switching devices 10,10', are suitably miniature electrical snap-action switches and are well known in the art and have conventional plunger type actuators 16,16' which are spring loaded, as indicated schematically at 3,3' in FIG. 2 whereby forces are provided acting in the direction indicated at 17,17' which require at least a minimum amount of force acting upon them in the opposite direction in order to be mechanically displaced as indicated at 18 in FIG. 2 and thus actuated, i.e. to switch contacts, or, for other types of control devices, to open a shutter, close a valve or the like. Upon removal of this actuating force the spring loaded actuators 16,16' are returned to their initial position. A bridge member, e.g. in the form of an elongate beam 20 is arranged adjacent and in bearing contact with both of the momentary actuators 16,16' and a pre-set mechanical force is applied to actuators 16,16' through bridge member 20, opposite to forces 17,17, by compression of compressible resilient member 22, e.g. a helical spring member, in the embodiment illustrated, arranged between bridge member 20 and cap member 24 which peripherally and fixedly engages housing 12 and surrounds the piston member 26 and sleeve 28. A helical spring is the preferred form of resilient member, however, other resilient compressible means can be used such as sealed gas containing bellows, leaf spring arrangements and the like. The force developed by the compression of spring 22 is less than that required to overcome the opposite forces due to spring loading forces of 17,17' of either of displaceable actuators 16,16', and is chosen to optimize the force required of rod member 26, actuated by displacement of diaphragm 31 which acts against bridge member 20, to obtain mechanical displacement of actuators 16,16'. The displacement of actuators 16,16' results in the actuation of control devices 10,10'. In the case of electrical snap switches this is the rapid transfer of the switch from one contact to another; the spring loaded contact snaps from its normal to operated position when the spring loading is overcome by mechanical force applied to the actuator as illustrated in FIG. 2(*b*). Rod member 26 acts against bridge member 20 through the integral extension 25 of bridge member 20 which loosely fits in cylindrical sleeve 28. Rod member 26, cylindrical in cross-section, slidably engaged in sleeve member 28, communicates with the chamber 30 formed by cap member 24 and resilient displaceable member 31 which is peripherally engaged to the base 32 of housing 12. Rod member 26 is in bearing engagement with the resilient displaceable member 31 by way of its cylindrical hollow extension 29 and disk member 34 on which it rests and is held in place by nipple 36. Disk 34 rests on resilient displaceable member 31 and upon displacement of member 31, rod member 26 undergoes a simultaneous and corresponding movement. A conventional hand operated bellows is indicated schematically at 40 in FIG. 2, and is operated by squeezing to compress air or other fluid in the tube 44 causing pressurized fluid to flow through the conduit 44 into the adjacent portion of chamber 30 and contact displaceable member 31 on its side 33 to thereby displace the displaceable member 31 into chamber 30. The displacement 18 of member 31 causes rod member 26 to be simultaneously displaced and to exert a force against bridge member 20, in the same direction as the pre-existent force developed by the compression of spring member 22; these cumulative mechanical forces, which are in substantial alignment with the longitudinal axes of piston member 26 and sleeve member 28 and bridge extension 25, are sufficient to displace bridge member 20 and displace and actuate both of the actuators 16,16' of switch devices 10,10' abutting bridge member 20 as indicated at 18,18'. To compensate when necessary for the difference in actuating forces required by the separate switches 10,10', mechanically adjustable biasing means, exemplified by set screws 46,46', are provided which threadably engage the top bracket 48 joined to back panel 49 of housing 12 and bear against the portions of the enclosing structures 13,13' of switch devices 10,10' which are spaced away and opposite the actuators 16, 16'. By advancing or retracting set screw means 46,46' a fixed, pre-set force can be provided to act on the respective actuators 16, 16'. This pre-set force can be varied, within limits, for each electrical switch. Consequently, mechanical differences between switches can be accommodated. At times a shim type of device, indicated at 59, which can be threadably engaged to sleeve 28 of the housing 12 so as to be adjustable, can be used to further compress spring member 22 which diminishes the force required from the compression of bellows 40. Increased compression of spring member 22 enables the use of increased lengths for tube 44 since increased pressure drops due to increased tube length are thus compensated.

With reference to FIG. 2(*c*), an embodiment of the bridge member 20 is illustrated which enables the sequential actuation of respective control devices 10,10' due to the recess 90 in the bridge member 20'. On account of the recess 90 the actuator 16' of control device 10' will be actuated subsequent to actuator 16 due to the greater degree of displacement required of bridge member 20. Similarly the bridge member can be provided with a raised portion 91 which would cause a control device 10'' to be actuated earlier than the other control devices.

Figure 3:
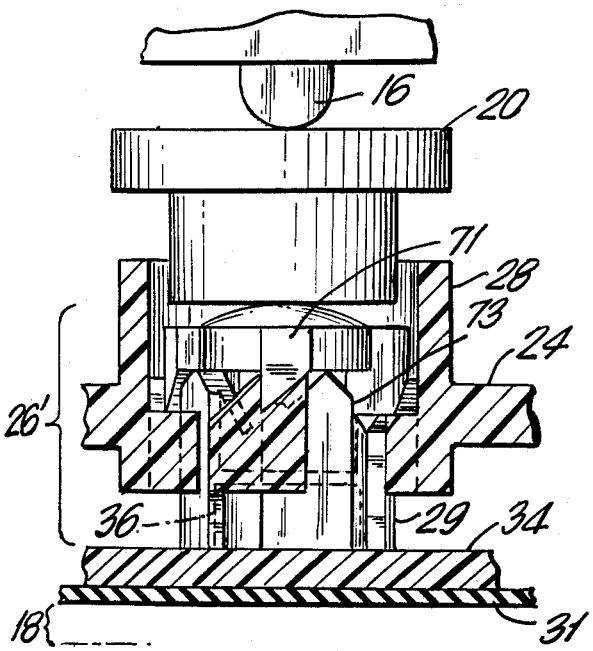
FIGS. 3, 3(*a*) and (*b*) show a conventional alternate action mechanism in combination with the device of the present invention.
Figure 3A:
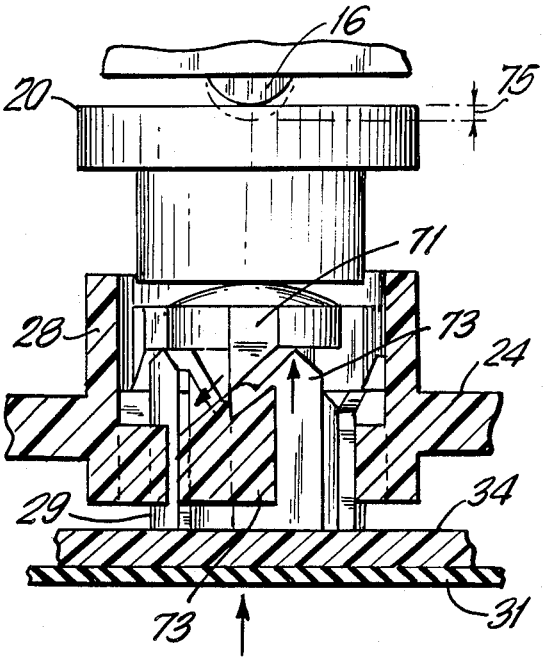
Figure 3B:
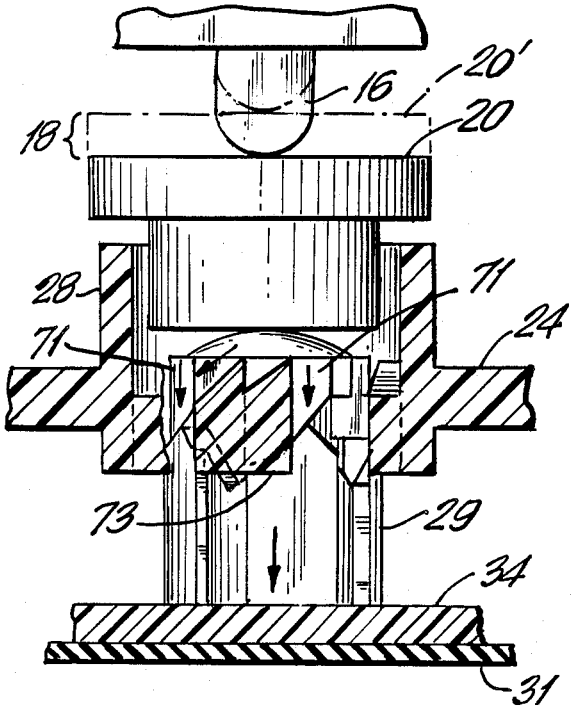

With reference to FIG. 3, it is known that various well known alternate action mechanisms, such as indicated at 26' in place of rod 26, comprising elements 71, 73 can be used so that after a first displacement the bridge member 20 remains in a position that is actuating the control device even after removal, or relaxation of the force provided by diaphragm 31 as illustrated in FIG. 3. The next displacement of diaphragm 31 and alternate action mechanism 26' with resultant over travel 75 of the actuator 16 of a conventional snap switch, illustrated in FIG. 3(*a*), releases the bridge 20 to return to its initial position and the control device is deactuated as illustrated in FIG. 3(*b*). This is due to the illustrated coaction of elements 73, 71 which form alternate action mechanism 26', which is the type that is used in the familiar "ball point pen" mechanism for extending and retracting the point.

What is claimed is:

1. A Fluid actuated control mechanism comprising a member displaceable by fluid having a discernible pressure from an initial position to a displaced position; a movable actuator member in communication with said displaceable member so as to move in one direction when said displaceable member moves to said displaced position, said actuator member having an actuator surface; a plurality of control devices engageable by said actuator surface when said displaceable member is in said displaced position thereby to cause said control devices to be in one of an on or off position wherein said actuator surface comprises a plurality of control actuating segments, each of said segments being movably engageable with one of said control devices when said actuator member moves in said one direction, at least one of said control actuating segments is closer to its associated one of said control devices than the other of said segments so as to contact said associated one of said control devices before the others of said control devices are contacted when said actuator member moves in said one direction; means for providing a first force tending to return said displaceable member to said initial position; and means for providing a second force tending to urge said actuator member in said one direction, said second force being adequate to overcome said first force to permit said displaceable member to move to said displaced position in the presence of said discerible pressure of said fluid.

2. The mechanism in accordance with claim 1, wherein a plurality of said control devices are arranged side-by-side.

3. The mechanism of claim 1 comprising means for adjusting said first and second forces in accordance with said discernible pressure to permit said displaceable member to move to said displaced position in the presence of said fluid.

4. The mechanism of claim 3 in which said adjusting means acts simultaneously to adjust each of said first and second forces.

5. The mechanism of claim 4 in which said adjusting means acts to adjust one of said forces acting in said one direction while simultaneously adjusting the other of said forces acting in a direction opposite to said one direction.

6. The mechanism of claim 1 in which each of said control actuating segments is positioned a different distance from its respective associated control device than the others of said control actuating segments whereby movement of said actuator member in said one direction causes sequential contact with and actuation of said control devices.

7. The mechanism of claim 1 in which said actuator surface is formed on a bridge member extending transverse to the direction of motion of said movable actuator member.

8. The mechanism of claim 7 in which said means for providing said first and second forces comprise respectively first and second compressible resilient means.

9. The mechanism of claim 8 in which said first compressible resilient means is arranged in compression to resist movement of said actuator member in said one direction and said second compressible resilient means is arranged in compression against said bridge to urge said bridge member to move in said one direction.

10. The mechanism of claim 9 in which said adjusting means comprises a rotatable element threadably mounted so as to be moved back and forth in said one direction.

11. The mechanism of claim 10 comprising means for communicating movement of said rotatable element to said first and second compressible resilient means so as to alter the compression thereof.

12. Apparatus in accordance with claim 8 wherein said first and second compressible resilient means are each in the form of a helical spring.

13. Apparatus in accordance with claim 12, wherein shimming means are provided for at least one of said resilient means to adjust the compression thereof.

14. A fluid actuated control device comprising a displaceable member adapted to be displaced from an initial position by pressurized fluid applied thereto and adapted to be returned to its initial position; a housing in which said displaceable member is peripherally engaged having spaced apart integral side members, and a chamber surrounding said displaceable resilient member; a sleeve member formed in one wall defining said chamber and communicating with said chamber; a rod member slidably engaged within said sleeve member and in bearing engagement with said displaceable member whereby movement of said displaceable resilient member results in corresponding and simultaneous movement of said rod member in said sleeve member; means for introducing a pressurized fluid into said chamber to contact the side of said displaceable resilient member opposite said rod member; a bridge member extending transverse to the direction of motion of said rod member and arranged to be in bearing contact therewith whereby movement of said rod member results in corresponding and simultaneous movement of said bridge member; a plurality of control devices each having respective spring loaded mechanically displaceable actuator members, said control devices being fixedly arranged side-by-side in said housing between the integral side members thereof with the respective actuator members being in bearing contact with said bridge member on a side thereof opposite said rod member whereby displacement of said bridge member results in displacement of said actuator members; a first resiliently compressible element adapted to provide a force urging said rod member to move so as to displace said actuator members; and a second resiliently compressible element adapted to provide a force urging said displaceable member toward said initial position.

* * * * *